US005874142A

United States Patent [19]

Hoffmann

[11] Patent Number: 5,874,142

[45] Date of Patent: Feb. 23, 1999

[54] LINERLESS ADHESIVE-EQUIPPED CARRIER ASSEMBLY AND METHOD

[75] Inventor: Donald J. Hoffmann, Elmhurst, Ill.

[73] Assignee: Wallace Computer Services, Inc., Lisle, Ill.

[21] Appl. No.: 519,987

[22] Filed: Aug. 28, 1995

[51] Int. Cl.[6] ..... G09F 3/10

[52] U.S. Cl. ..... 428/40.1; 40/594; 40/630; 40/638; 281/2; 281/5; 283/71; 283/74; 283/81; 283/101; 428/41.8; 428/42.1; 428/43; 428/138; 428/192; 428/906

[58] Field of Search ..... 428/40.1, 41.8, 428/42.1, 43, 906, 192, 138, 354, 352; 283/81, 71, 101, 74; 40/630, 638, 594; 206/390, 820; 281/2, 5

[56] References Cited

U.S. PATENT DOCUMENTS

| | | | |
|---|---|---|---|
| 1,906,909 | 5/1933 | Lawrence | 428/352 |
| 4,592,572 | 6/1986 | Instance | 428/40.1 |
| 4,744,591 | 5/1988 | Instance | 428/40.1 |
| 4,830,406 | 5/1989 | Instance | 428/40.1 |
| 4,849,043 | 7/1989 | Instance | 428/40.1 |
| 4,894,106 | 1/1990 | Instance | 428/40.1 |
| 4,940,258 | 7/1990 | Cuba | 283/81 |
| 5,254,381 | 10/1993 | Hoffmann et al. | 428/40 |
| 5,262,214 | 11/1993 | Instance | 428/40 |
| 5,354,588 | 10/1994 | Mitchell et al. | 428/352 |
| 5,431,763 | 7/1995 | Bradshaw | 156/256 |
| 5,547,738 | 8/1996 | Mitchell et al. | 428/352 |

FOREIGN PATENT DOCUMENTS 192 444 8/1986 European Pat. Off. .

*Primary Examiner*—Nasser Ahmad
*Attorney, Agent, or Firm*—Lee, Mann, Smith, McWilliams, Sweeney & Ohlson

[57] ABSTRACT

A carrier assembly including a label, coupon, booklet or the like for application to a container or other receiver which has an elongated flexible carrier web having opposed faces, one face being equipped with adhesive, the other face being equipped with release material, and a plurality of longitudinally spaced web-units attached to the one face, the carrier web being convolutely wound with the space between the web-units exposing said adhesive.

Also disclosed is the method of preparing and the method of using wherein the wound roll is unwound and one web-units sequentially dispensed as by severing a segment from the carrier web and applying the same to a receiver.

21 Claims, 3 Drawing Sheets

FIG. 1
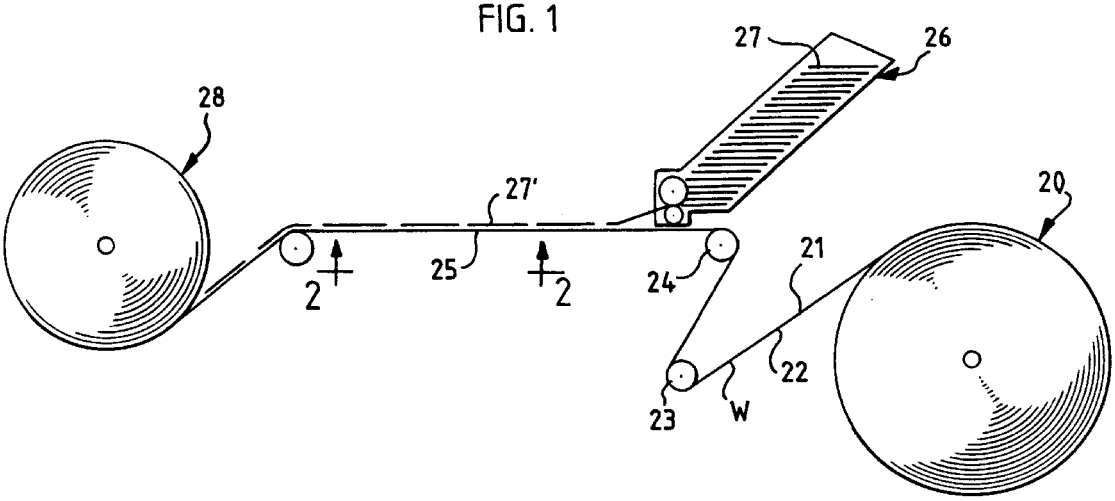
FIG. 2
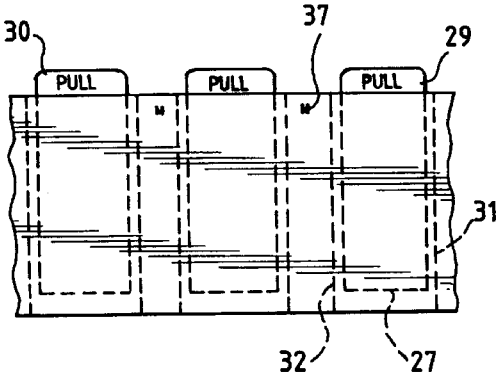
FIG. 3
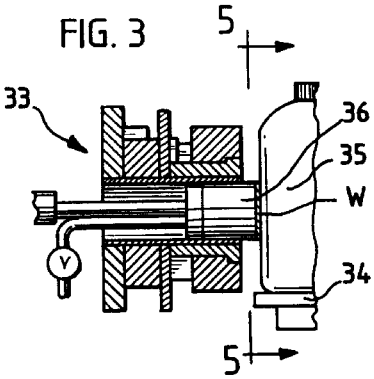
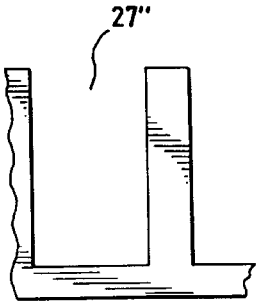
FIG. 4
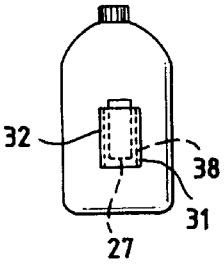
FIG. 5
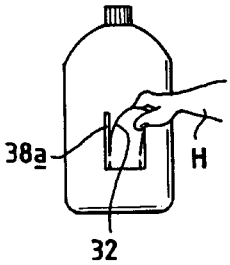
FIG. 6
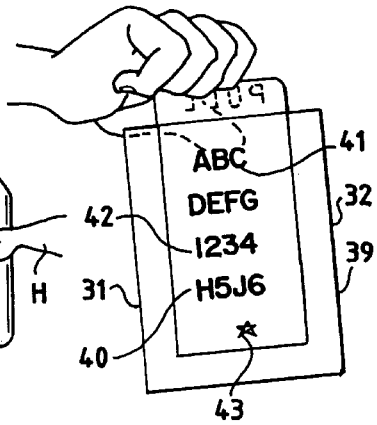
FIG. 7

FIG. 8
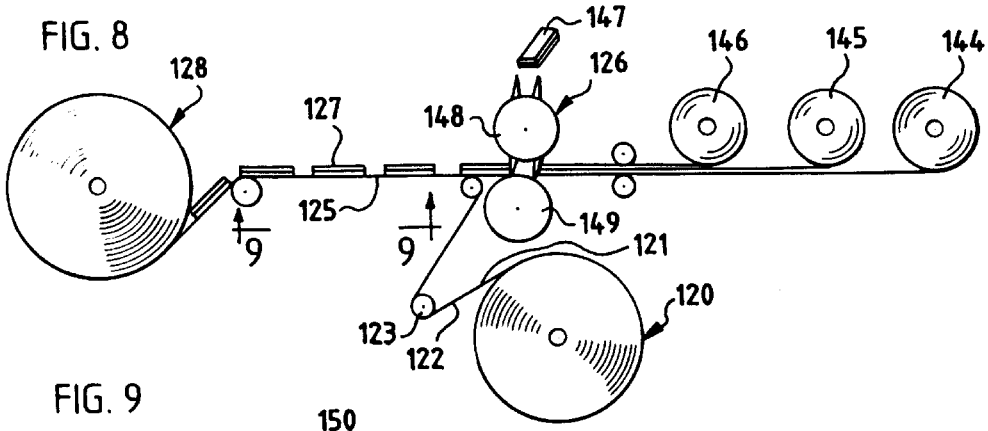
FIG. 9
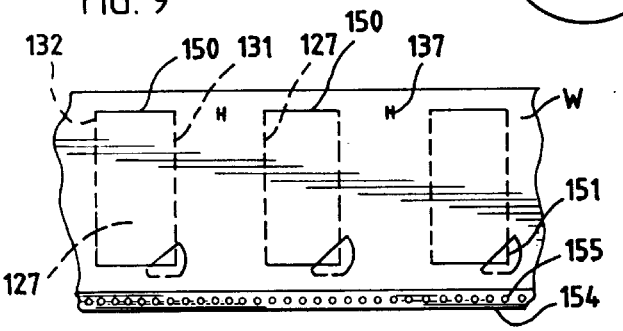
FIG. 11
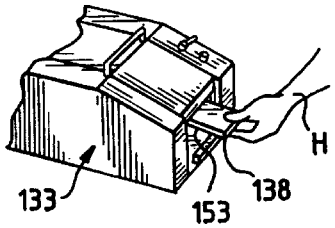
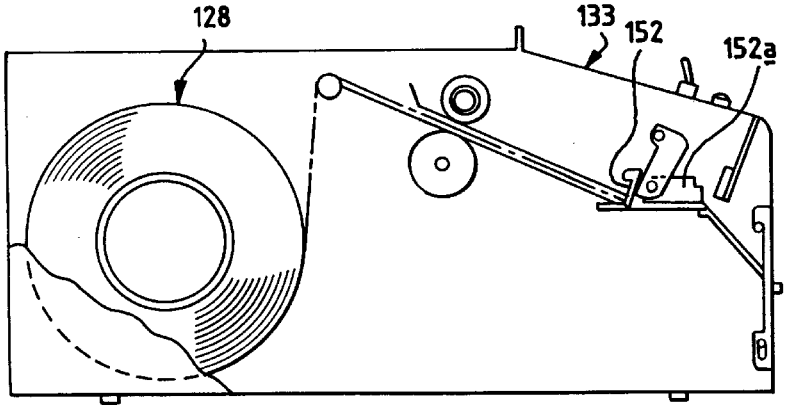
FIG. 10
FIG. 12
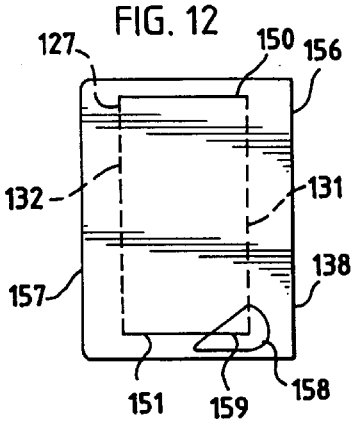
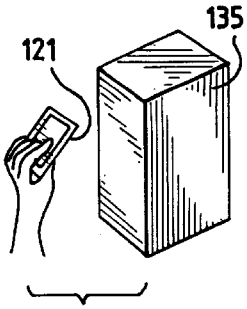
FIG. 13
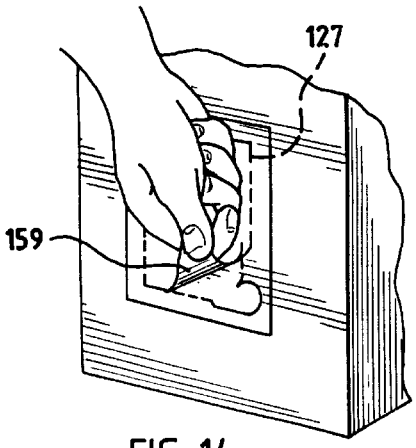
FIG. 14
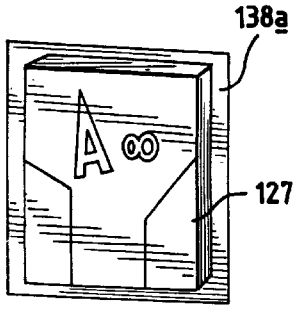
FIG. 15

LINERLESS ADHESIVE-EQUIPPED CARRIER ASSEMBLY AND METHOD

BACKGROUND AND SUMMARY OF INVENTION

This invention relates to linerless adhesive-equipped carrier assembly and method and, more particularly, to a product and method which is especially adapted for providing information web-units such as coupons, booklets, and the like as label assemblies for various products.

The invention includes the use of a roll of linerless label stock consisting of paper or clear poly film that has been produced by using conventional manufacturing processes, e.g., a label press equipped with print towers, silicone coater and an adhesive applicator. The linerless label stock may or may not be slit, perforated or punched—as may be useful in assisting of the removal of the booklet, coupon, card, etc. This roll of linerless paper/film may also have aligning holes or preprinted registration marks for achieving register.

The linerless carrier roll is advantageously mounted on an unwind stand of a mailer type collator and webbed, i.e., advanced, with the adhesive side up and with the web passing underneath a diecut tipping station, for example. Single or multiple plies from the mailer collator are webbed through the diecutter and tipped onto the adhesive side of the linerless label. In lieu of a diecutter/chipout unit, a label applicator or tipper could also tip inserts or web units onto the linerless label. After the inserts are tipped in register on the moving linerless paper/film, the web is wound into a roll in longitudinally spaced locations. The plies/inserts that are tipped sequentially in register onto the linerless ply can be, among other things, single I.D. cards, coupons, booklets, postcards, business reply envelopes, etc.

An advantage of using a collator is that the various plies can be different paper weights and colors. They can also be plowed before going through the die cut station.

After the completion of the web-unit-equipped linerless ply, it is wound to form a linerless adhesive-equipped carrier assembly in convolutely wound form with adhesive being exposed between adjacent web-units. This permits direct application of the web-unit-equipped segment of the carrier directly to a receiving surface, such as a container—and without the need for removing a release liner at the time of application. Exemplary of the prior art featuring folded inserts on a carrier ply wherein a release liner must be removed before application to a receiving surface is U.S. Pat. No. 5,262,214 and European Patent Application publication 192 444.

According to the invention, the roll resulting from the convolute winding normally is relocated for advantageous use in conjunction with a stream of products. The products may vary widely from milk cartons to shipping boxes to bottles and containers of all sorts—in other words, anything whether filled or not which can make use of a removable information-containing web-unit. As the containers to be equipped with the web-units are advanced, the linerless carrier is likewise advanced and selectively severed to provide transferrable items for application to the stream of containers.

Then, when the container or other item bearing the web-unit reaches its final destination, the recipient is easily and readily able to remove the web-unit from the container for the information it is intended to convey.

Other objects and advantages of the invention may be seen in the details of construction and operation set forth in the ensuing specification.

BRIEF DESCRIPTION OF DRAWING

The invention is described in conjunction with the accompanying drawing, in which FIG. 1 is a schematic side elevation of a labeling assembly useful in the practice of the invention;

FIG. 2 is a bottom plan view of the carrier web portion seen in the central part of FIG. 1;

FIG. 3 is a fragmentary sectional view of apparatus for selectively severing portions of the web of FIG. 2 and applying the same to a container;

FIG. 4 is a fragmentary plan view of the remnant or "ladder" of the carrier web of FIG. 2 after it has passed through the removal operation provided by the apparatus of FIG. 3;

FIG. 5 is a side elevational view of a container equipped with the medium-equipped carrier of the invention and as would be seen along the sight line 5—5 of FIG. 3;

FIG. 6 is a view similar to FIG. 5 but showing the web-unit-equipped carrier web in the process of being removed from the container;

FIG. 7 is an enlarged front view of the "removed" web-unit-equipped carrier with the carrier being reversed from its showings in FIGS. 5 and 6;

FIG. 8 is a view similar to FIG. 1 in that it is a schematic representation of a processing line for webs but which is especially adapted to apply multiple plies or sheets of each web-unit to the carrier web and thereby provide a series of booklets or similar thicker web-units;

FIG. 9 is a bottom plan view of the carrier web equipped with longitudinally spaced stacks of web-unit such as would be seen along the sight line 9—9 of FIG. 8;

FIG. 10 is a schematic representation of apparatus employed for intermittently providing linerless adhesive-equipped carrier assemblies—such as labels or booklets and which can be used to advantage in the practice of the invention;

FIG. 11 is a fragmentary perspective view of the apparatus of FIG. 10 shown in the process of delivering a carrier segment adhesively-equipped with a web-unit;

FIG. 12 is a front elevational view of the carrier segment which has issued from the apparatus of FIG. 11;

FIG. 13 is a fragmentary perspective view showing the web-unit-equipped carrier segment of FIG. 12 in the process of being applied to a container;

FIG. 14 is a view similar to FIG. 13 but showing the web-unit in the process of being removed from the container;

FIG. 15 is a rear elevational view of the web-unit after it was removed from the container as seen in FIG. 14.

DETAILED DESCRIPTION

Figure 16:
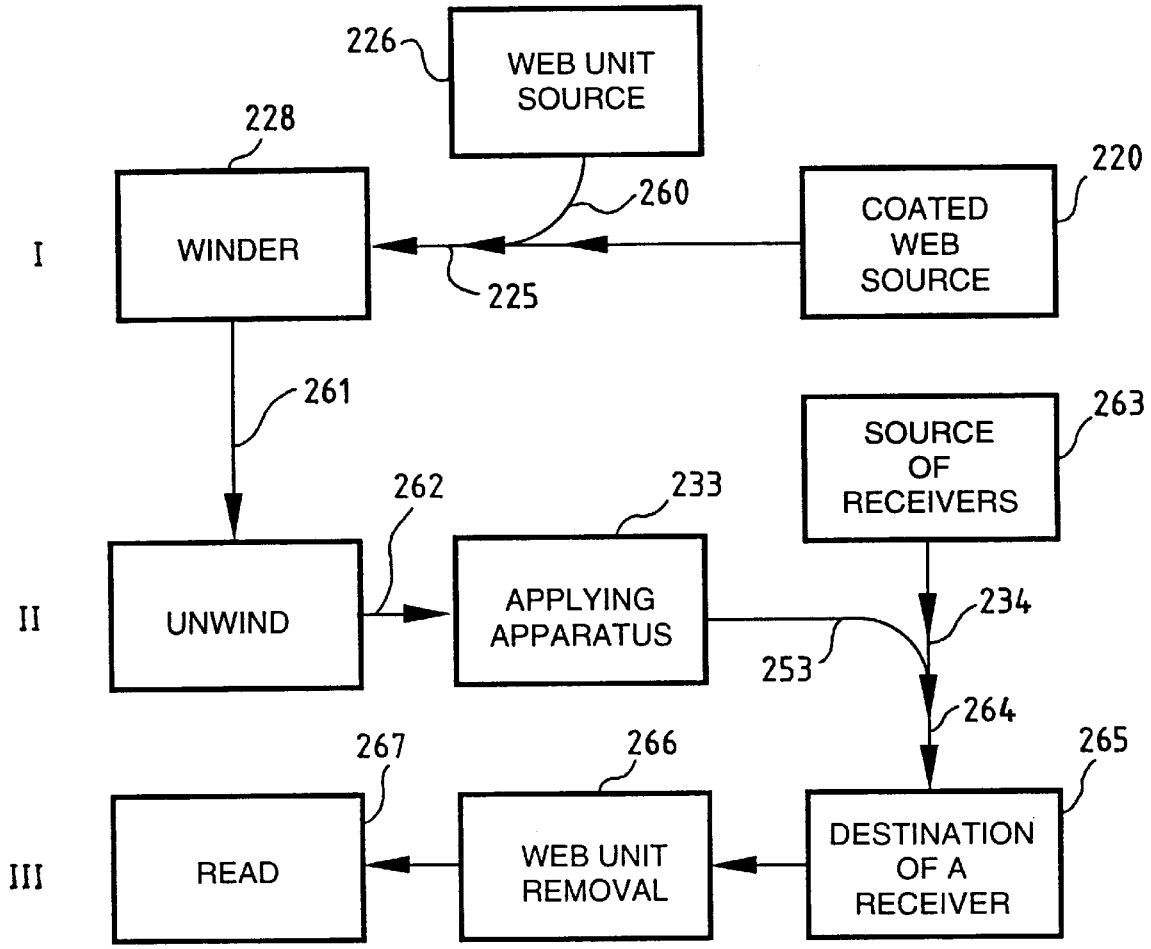
FIG. 16 is a schematic diagram of the process of making the web-unit-equipped carrier web at a first site, the application of web segments to a series of receivers at a second site and the receipt, removal and reading or otherwise sensing of the information on this web-unit at a third site.

With reference first to FIG. 1, the numeral 20 designates generally a parent roll of "linerless label" material. This term has been fairly widely used to refer to coated web material useful as a label wherein one face is equipped with adhesive and the other face with a release material, usually a silicone composition. One advantageous adhesive is the pressure sensitive type (hot melt or water soluble) but other useful adhesives may be dry gum or heat activated glue. The booklets, coupons, cards, etc. are then glued at various points to the non-pressure sensitive adhesive.

In the practice of the invention, the roll 20 is unwound to provide a web W which, in the illustration given, has the adhesive side positioned uppermost as at 21 and the silicone coated side positioned downwardly as at 22. For brevity hereafter. I use the term "silicone" for the release material but it will be understood that a variety of wax-like materials may be used to provide the release quality.

In some instances, it may be necessary to change the direction of advance of the web W and therefore it passes around an idler roller 23 which is advantageously coated with a release material such as the previously mentioned silicone product.

To provide a run of web W especially arranged to receive web-units, the web W again changes direction by passing around a second idler roller 24 and thereafter has a generally horizontally extending run 25. Positioned at the right hand or beginning end of the horizontal run 25 is an insert feeder generally designated 26. This is in the nature of a magazine containing a stack of web-units 27 which are dispensed serially as at 27' on the horizontal run 25 in FIG. 1. These then are rewound into a convolutely wound roll generally designated 28 for subsequent processing.

As indicated in the drawing description, FIG. 2 is a bottom plan view of the web W equipped with the web-units 27. Each web-unit is spaced longitudinally from its neighbors and advantageously equally spaced as shown. Additionally, each unit 27 has a projecting tab as at 29 (see the right hand end of FIG. 2). This may be equipped with instructional indicia such as the word PULL as designated by the numeral 30.

In this particular instance, I find it advantageous to provide the web W with transverse perforations 31 and 32 flanking each web-unit 27. Again, these can be equally spaced on either side of the web-unit 27 and the provision of these perforations can be advantageously provided prior to the addition of the web-units 27. For example, the web W may be cross perforated even before being equipped with adhesive and silicone or during the application of these surfaces or even during later unwinding after the web has been wound into the parent roll 20.

After the web W has been unwound from the rewind roll 28 to provide the web seen in FIG. 2, it is advanced past a label removal/applying apparatus generally designated 33. Greater details of the particular unit illustrated may be seen in U.S. Pat. No. 5,431,763 which shows a conveyor as at 34 for advancing a series of containers as at 35 past the severing/applying apparatus 33.

The apparatus of the '763 patent also provides means for advancing a web W through the device 33 parallel to the run of conveyor 34. A plunger 36 is operative to sever a web segment from the web W and through the use of vacuum V apply it to a side of the container 35. This may be triggered by a sensor (not shown) which is responsive to registration marks 37—see FIG. 2. Resulting from the operation of the apparatus 33 in the container 35 of FIG. 5 which is now equipped with a web-unit 27 and a continuous strip of waste material as seen in FIG. 4. This can be rewound for disposal as shown in the '763 and '214 patents, previously mentioned.

More particularly, the apparatus 33 may sever a web segment 38—see FIG. 5—which is slightly broader than the web-unit 27. In any event, this results in the gap or chipped out area as at 27" in FIG. 4. In FIG. 5, it will be noted that the web segment 38 is also slightly broader than the distance between the flanking cross perforation lines 31 and 32.

Then, when the web-unit is torn away by the hand H—see FIG. 6—it will be seen that a minor perimetric portion **38*a* remains on the container 35. This is the perimeter portion outboard of the perforation lines 31, 32. And these perforation lines may themselves be outboard of the leading and trailing edges (in the sense of the FIG. 2 showing) of the web-unit 27. Or, in other instances, the perforation lines may be co-linear with the leading and trailing edges of the web-unit 27. And, for that matter, in some instances, the perforation lines 31, 32 may be omitted entirely. This could be the case where the web W is fairly easily ruptured to permit removal of the web-unit 27. Even further, the segment 38 may be coextensive with the web unit 27**—especially where the adhesive employed is rupturable. Depending on the product that the web-unit, i.e., label, is applied to, a greater surface area of adhesive may be employed to adhere to the product.

Returning to the illustration given in FIGS. 1–7, the result of the removal step pictured in FIG. 6 is a slightly smaller web segment 39 which carries the web-unit 27 and therefore the informational message 40 as seen in FIG. 7. This is seen to include variously alpha, indicia 411, numeric indicia 42 and pictorial indicia 43. It will be appreciated that other indicia may be printed or otherwise provided on the web units 27.

Variations may be made in the details of construction and operation of the product, the apparatus and the method employed in the practice of the invention. For that purpose, I set down details of a second embodiment and it will be appreciated that certain of the elements and steps of the second embodiment may be substituted in the first embodiment and vice versa.

Alternative Embodiment

Here, reference is made to FIGS. 8–15 and so that there is clear understanding of the differences, yet similarities to the elements, steps, etc. of FIGS. 1–7, I employ like numerals for like elements but with the addition of 100.

Therefore, in FIG. 8, the numeral 120 represents a roll for unwinding of linerless label material which again passes over a silicone coated idler roller 123 and a second idler roller 124. As before, the adhesive side 121 is facing upwardly when first unwound while the silicone coated side initially faces downwardly and is designated by the numeral 122. Again, as before, there is a straight run of web W as at 125. Here, I do not change the designation of the web W because what I use most advantageously is generic and therefore the web is useful in either embodiment or such other embodiments as may be made up of elements from part of one embodiment and part of a second embodiment.

In FIG. 8 at the right hand side thereof, it will be noted that there are three parent rolls 144, 145 and 146. Each of these provides a web which is advanced by pull rolls 147. The webs from the parent rolls 144–146 are advantageously held together by glue lines applied at the collator (not shown). These glue lines can be applied at the sides or along the top of the webs.

Thereafter the superposed webs from the parent rolls 144–146 pass through a chip-out unit generally designated 126 where a "chip" of the three webs as at 147 is removed by the coaction of the knife roll 148 and the anvil roll 149. Thereafter, the superposed web elements 127 are deposited on the web W which serves as a carrier and adhesively secures the lowest component of the web-unit, i.e, the part from the parent roll 144. The web-units 127 maintain their various components in superposed, stacked relationship by virtue of being pressed by the pull rolls 147*a* to unite the webs by the above-mentioned glue lines. They are then conveyed by the web W to become the rewind roll generally designated 128.

Reference to FIG. 9 reveals a length of web material very much as was previously seen in FIG. 2 and wherein the web-units 127 are seen in dashed line indicating that the view in FIG. 9 is from the bottom of FIG. 8 and therefore the edges of the web-units 127 are "hidden".

A refinement which I optionally employ in connection with the embodiment of FIGS. 8–15 is to provide the web W with a series of longitudinally extending slits as at 150 and 151 for each web-unit 127. Also, I have a further punch-out to provide a finger access opening as at 146 for each one of the web units 127. Again, as before, I find it advantageous to provide flanking perforation lines as at 131 and 132—see the extreme left unit of FIG. 9. Here, the perforation lines are aligned with the leading and trailing edges of the web-unit.

The web W of FIG. 9 can be used in conjunction with the severing/applying unit 33 of FIG. 3 which then would be synchronized with the advance of the conveyor 34. However, in the showing of FIGS. 8–15, I use an alternative severing means in the form of a unit generally designated 133 in FIGS. 10 and 11. Additional details of the unit 133 can be seen in the co-owned application of Szczepaniec et al, Ser. No. 08/474,709, filed Jun. 26, 1995. The unit 133 has provision for unwinding the rewound roll 128 and directing it through a knife means 152 to issue a web segment 138 from an outlet 153—see FIG. 11. This is with the adhesive side 121 of the web segment 138 facing upwardly. The knife means 152 may include a sensor 152*a* which is triggered by registration marks as at 137. The margin may be trimmed to provide the construction of FIG. 12.

The unit 133 operates intermittently, i.e., upon demand, and a hand H is seen removing the segment 138. Again, the segment 138 removed has with it a portion of the web W as can be appreciated from FIG. 12 where again we see the perforation lines 131, 132 inboard of the leading and trailing edges 156, 157 edges of the segment 138. Also seen are the longitudinally extending slits 150 and 151 which intersect the lines of perforations 131, 132. For further convenience in removal, I provide a finger opening 158 which provides convenient access to the web unit 127 for removal as seen in FIG. 14. The segment 138, with its adhesive face 121 facing a receiver 135, is applied in the fashion indicated at FIG. 13.

Then in FIG. 14, the removal of the web-unit 127 is illustrated which is initiated by grasping the unit near the corner 159 (compare FIGS. 12 and 14) and rolling the same upward for tearing the web W along the perforation lines 131 and 132.

Alternatively, the slits and perforation lines may be omitted—resulting in the structure seen in FIG. 15 where the web-unit 127 of multi-ply construction is equipped with alpha/numeric indicia and still may retain a small perimetric portion of the web W.

Summary of Operation

Turning now to FIG. 16, I present a schematic flow diagram which illustrates the use of the invention in three stages. In stage 1, there is provided a coated web source 220. The coated web has opposed faces one of which is equipped with pressure sensitive or other adhesive and the other with silicone or other release material. This normally-designated "linerless label" material may be either developed at the Site I or provided elsewhere. In the same fashion, the coated web may be equipped with registration means, one for each location where a web unit 27, 127 is to be applied. Such registration means may take the form of registration marks 37, 137 or holes such as the line holes 155 in the margin 154.

The coated web normally is provided in convolutely wound form and is unwound for advancing along a path 225 (still referring to FIG. 16).

Intersecting the path 225 is a path 260 which leads from a web unit source 226. The web-units are advantageously equipped with informational indicia of the type depicted at 40–43 in FIG. 7 and further are configured to provide a member selected from the class consisting of a booklet, a coupon, a credit card, and I.D. card, a postcard, and a reply envelope such as a business reply envelope.

The web-units emanating from the web-unit source 226 and advancing along the path 260 may be applied to the web W advancing along the path 225 by a variety of operations such as tipping, blowing, diecutting to chip the web-unit out of a continuous stream and other forms of application. Normally, the web-units are applied in equally longitudinally spaced positions on the web face containing the pressure sensitive adhesive. Thereafter, the web-unit-equipped web is rewound into a convolutely wound roll as at 228.

The convolutely wound web as at 28 in FIG. 1 or 128 in FIG. 8 is normally cartoned for transfer to a second Site II—this being indicated by the vertical arrow designated 261.

The first Site I normally will be the manufacturing plant of a business form producer or like operating entity. In contrast, the second Site II will normally be that of a product-producing plant. As indicated previously, the ultimate web-units may be applied to food receivers such as milk cartons—in which case, the second Site II would be a dairy.

At Site II, the convolutely wound roll 28, 128 is unwound and advanced along a path 262 to applying apparatus 233. A variety of applicators can be employed but in each case means are provided for transversely severing the web W into discrete segments such as 38, 138. Illustrative of some of the variations of applying apparatus are the apparatus 33 of FIG. 3 which embodies a plunger to remove a portion of the web, leaving a ladder-like remanant to be disposed of, or a completely severing apparatus 133 as seen in FIG. 10 and 11. In the case of the plunger equipped dispenser of FIG. 3, the web unit is severed as a segment 38. In the instance of a knife-equipped dispenser seen in FIGS. 10 and 11, the web W is completely severed between web-units 27, 127 and these segments are issued from the apparatus for manual manipulation in the illustrated embodiment.

In the two embodiments illustrated, perforation lines as at 31, 32 and 131, 132 are illustrated. These, along with the slits 150, 151 are advantageously applied to the web W at the source 220. The perforation lines—as indicated previously—may be applied either co-linerarly with the leading and trailing edges of the web-units as in FIG. 12, spaced from the edges as in FIG. 2 or omitted—as where the web W can be readily replaced or totally removed from the receiver.

The applying apparatus 233 operates in conjunction with a source of receivers 263. Where the receivers are food cartons as at 35, 135, they are provided along a conveyor which defines a path 234 and which intersects the output 253 of the apparatus 233. Thereafter, the now-web segment-equipped receivers are transferred to Site III—this being indicated by the arrow designated 264.

The third site site III is a destination 265 which may be the household receiving the milk carton or a variety of other sites where the segment 38, 138 may be removed as shown in FIGS. 6 and/or 14. This action is designated by the block reading web-unit removal and is designated 266.

Thereafter, the information contained on the removed web-unit is read as at 267.

While in the foregoing specification a detailed description of an embodiment of the invention has been set down for the purpose of illustration, many variations in the details hereingiven may be made by those skilled in the art without departing from the spirit and scope of the invention.

I claim:

1. A linerless carrier assembly comprising an elongated flexible carrier web having opposed faces, one face being substantially completely covered with adhesive, the other face being substantially completely covered with a waxy release material, and a plurality of longitudinally spaced apart web-units each having first and second faces, said web-unit first face being adhesively attached to said carrier web one face and with said web unit second face being free of adhesive, the space between said web-units exposing said adhesive, said carrier web being convolutely wound, each of said web-units is provided with informational indicia.

2. The product of claim 1 in which each of said web-units is a booklet.

3. The product of claim 1 in which each of said web-units is a coupon.

4. The product of claim 1 in which each of said web-units is a credit card.

5. The product of claim 1 in which each of said web-units is an I.D. card.

6. The product of claim 1 in which each of said web-units is a postcard.

7. The product of claim 1 in which each of said web-units is a business reply envelope.

8. The product of claim 1 in which said informational indicia comprises at least one of alphabetic characters, numeric characters and pictorial indicia.

9. The product of claim 1 in which informational indicia is imprinted on said carrier web.

10. The product of claim 1 in which said carrier web is equipped with transversely-extending lines of perforation flanking each web-unit.

11. The product of claim 1 in which each web-unit is equipped with a tab portion projecting transversely beyond said web.

12. The product of claim 11 in which said tab portion is equipped with informational indicia.

13. The product of claim 1 in which said carrier web is equipped with registration indicia for each web-unit.

14. The product of claim 1 in which said registration indicia is a mark.

15. The product of claim 1 in which said carrier web is equipped with a margin having longitudinally spaced line holes.

16. The product of claim 1 in which said carrier web is equipped with longitudinally-extending slits flanking each web unit.

17. The product of claim 16 in which said carrier web is equipped with a finger-accessible opening adjacent one of said slits.

18. The product of claim 17 in which said carrier web is equipped with transversely extending lines of perforation generally aligned with the forward and trailing edges of each web-unit and intersecting said slits whereby finger insertion into said opening permits removal of a web patch having generally the extent of said web-units.

19. The product of claim 18 in which said web-unit is equipped with informational indicia and is a member selected form the class consisting of a booklet, a coupon, a credit card, an I.D. card, a postcard, and a reply envelope.

20. A linerless carrier assembly comprising an elongated flexible web having opposed faces, one face being substantially completely covered with adhesive, the other face being substantially completely covered with a waxy release material, and a plurality of longitudinally spaced apart web-units each having first and second faces, said web unit first face being adhesively attached to said carrier web one face and with said web unit second face being free of adhesive, the space between said web-units exposing said adhesive, said web being convolutely wound, each said web-unit when removed from said flexible web having a first surface equipped with said flexible web with the release material thereof facing outwardly of said web-unit and a second surface free of adhesive to facilitate manual handling of the removed web unit, each of said web-units is provided with informational indicia.

21. The product of claim 20 in which said web is equipped with transversely-extending lines of perforation flanking each web-unit.

* * * * *